US005115872A

United States Patent [19]

Brunet et al.

[11] Patent Number: 5,115,872

[45] Date of Patent: May 26, 1992

[54] DIRECTIONAL DRILLING SYSTEM AND METHOD FOR DRILLING PRECISE OFFSET WELLBORES FROM A MAIN WELLBORE

[75] Inventors: Charles G. Brunet, Lafayette, La.; Gilles E. Labbeé, Spring; Jay W. McGee, Houston, both of Tex.

[73] Assignee: Anglo Suisse, Inc., Houston, Tex.

[21] Appl. No.: 599,756

[22] Filed: Oct. 19, 1990

[51] Int. Cl.[5] ..... E21B 7/08

[52] U.S. Cl. ..... 175/61; 166/117.5; 166/50; 175/82

[58] Field of Search ..... 175/61, 62, 73, 74, 175/75, 79, 82; 166/50, 117.5

[56] References Cited

U.S. PATENT DOCUMENTS

| | | | |
|---|---|---|---|
| 2,669,428 | 2/1954 | Zublin | 174/82 X |
| 2,965,182 | 12/1960 | Galeener | 175/82 |
| 3,191,697 | 6/1964 | Haines | 175/82 X |
| 3,336,990 | 8/1967 | Warner et al. | 175/82 |
| 4,856,666 | 8/1989 | Brunet et al. | 166/117.5 X |

*Primary Examiner*—Stephen J. Novosad

*Attorney, Agent, or Firm*—Pravel, Gambrell, Hewitt, Kimball & Krieger

[57] ABSTRACT

A directional drilling apparatus for drilling offset wellbores from a main borehole using a steering tool to orient a guidance tool body and wherein the tool body has a pair of angularly intersecting passageways including a first smaller passageway that communicates with a packer, and a second larger passageway that cradles a smaller drill string for drilling the offset boreholes and wherein the smaller drill string will not fit in the first smaller passageway.

10 Claims, 6 Drawing Sheets

DIRECTIONAL DRILLING SYSTEM AND METHOD FOR DRILLING PRECISE OFFSET WELLBORES FROM A MAIN WELLBORE

BACKGROUND OF THE INVENTION

1. Field of the Invention

The present invention relates to directional drilling and more particularly relates to a system for the drilling of precisely located offset wellbores drilled at a selected radial location with respect to the main wellbore and/or for coring in an oil/gas well, wherein a dual passageway deflection tool allows a packer to be set downstream thereof and a survey tool can be used to select a particular radial position for drilling a selected offset wellbore.

2. General Background

The drilling of offset wellbores is discussed generally in U.S. Pat. No. 4,519,463 entitled "Drainhole Drilling" issued to Frank Schuh and assigned to Atlantic Richfield Company. In the Schuh patent, a method for drilling a well in the earth for producing minerals therefrom is provided wherein a primary wellbore is first drilled into the earth, the primary wellbore being a deviated wellbore having a radius of curvature in the range of from about 2.5 to about 6 degrees per one hundred feet of primary wellbore length, and then drilling from the primary wellbore at least one drain hole wellbore, the drain hole wellbore having a radius of curvature in the range of from about 0.2 to about 3 degrees per one foot of drain hole wellbore length.

Another patent relating to the drilling of offset wellbores is U.S. Pat. No. 4,852,666 issued to Charles Brunet and Alton Watson. The following table lists other patents that relate generally to the drilling of inclined wells, horizontal wells, and offset wells.

| U.S. Pat. No. | INVENTOR | TITLE | ISSUED |
|---|---|---|---|
| 4,365,676 | Boyadjieff | Method and Apparatus For Drilling Laterally From A Well Bore | 12/28/82 |
| 4,402,551 | Wood | Method and Apparatus To Complete Horizontal Drain Holes | 09/06/83 |
| 4,436,165 | Emery | Drain Hole Drilling | 03/13/84 |
| 4,444,265 | Schmidt | Drain Hole Drilling | 04/24/84 |
| 4,501,337 | Dickinson | Apparatus For Forming And Using A Bore Hole | 02/26/85 |
| 4,545,435 | Bridges | Conduction Heating Of Hydrocarbonaceous Formations | 10/08/85 |
| 4,573,531 | Garkusha | Method of Underground Gasification of Coal Seam | 03/04/86 |
| 4,598,770 | Shu | Thermal Recovery Method For Viscous Oil | 07/08/86 |
| 4,605,076 | Goodhart | Method For Forming Boreholes | 08/12/86 |
| 4,621,691 | Schuh | Well Drilling | 11/11/86 |
| 4,646,836 | Goodhart | Tertiary Recovery Method Using Inverted Deviated Holes | 03/03/87 |
| 4,653,583 | Huang | Optimum Production Rate For Horizontal Wells | 03/31/87 |
| 4,662,441 | Huang | Horizontal Wells At Corners of Vertical Well Patterns For Improving Oil Recovery Efficiency | 05/05/87 |
| 4,682,652 | Huang | Producing Hydrocarbons Through Successively Perforated Intervals of A Horizontal Well Between Two Vertical Wells | 07/28/87 |
| 4,696,345 | Hsueh | Hasdrive With Multiple Offset Producers | 09/29/87 |
| 4,700,779 | Huang | Parallel Horizontal Wells | 10/20/87 |
| 4,705,431 | Gadelle | Method For Forming A Fluid Barrier By Means Of Sloping Drains, More Especially In An Oil Field | 11/10/87 |
| 4,715,452 | Sheppard | Method of Drilling A Directional Well Bore | 12/29/87 |
| 4,714,117 | Dech | Drainhole Well Completion | 12/22/87 |

The Boyadjieff '676 patent uses a self-propelled drilling unit.

The wood '551 patent used a cementing step in directional drilling.

The Emery '165 patent relates to the use of a hardening material in directional drilling.

The Schmidt '265 patent relates to a method for drilling into the earth wherein both gas and liquid are produced wherein the earth is treated to render the treated portion essentially impermeable to gas.

The Dickinson '337 patent, assigned to Bechtel National Corp., uses a hollow central pipe disposed in a central passageway in forming bore holes.

The Bridges '435 patent relates to heating of earth formations that involves the application of electrical power.

The Garkusha '531 patent relates to a method of underground gasification of a coal seam and includes steps of igniting the coal and gasifying the same.

The Shu '770 patent relates to a thermal recovery method that uses a plurality of substantially parallel horizontal production wells and a plurality of vertical injection wells.

The Goodhart '076 patent contemplates boring from an essentially vertical hole. The method contemplates drilling upwardly from the vertical hole, a deviated hole into the target zone.

The Schuh '691 patent contemplates the use of separate drilling zones in a grid fashion which do not connect.

The Goodhart '836 patent contemplates us initial vertical shaft as part of its method and also injecting a heating fluid from the surface to the outer loop borehole and directing the heating fluid into a loop comprising the outer loop borehole and the portion of the vertical shaft between the top and bottom of the outer loop borehole with the return of heating fluid to the surface via the vertical shaft.

The Huang '583 patent relates to a method of enhancing recovery of hydrocarbons. The method determines the optimum fluid production rate for a producing horizontal well which will limit the downward movement of the fluid medium towards the horizontal well to a velocity below critical velocity to avoid fingering of the fluid medium through the formation. The critical velocity is defined by a formula.

The Huang '441 patent relates to a modified inverted spot well pattern for recovering hydrocarbons from an underground formation. The method uses a pair or substantially horizontal production wells at each of the four corners of the pattern, the horizontal wells extending from the ground surface and running substantially horizontal distance with the hydrocarbon formation, each pair of horizontal wells forming an x-shaped aerial pattern and a substantially vertical central injection well.

The Huang '652 patent also relates to a method for producing hydrocarbons. Each of those claims includes the use of an injection well.

The Hsueh '345 patent contemplates an injection well as part of a method of recovering petroleum.

The Gadelle '431 patents relates to injecting a fluid into a geological formation or injection wells.

The Sheppard '452 patent uses a multi section borehole which includes a first vertical section. The second section of the borehole has a substantially constant build rate.

The Dech '117 patent uses a casing string composed of alternating casing subs and external casing packer subs.

One of the problems associated with the drilling of offset wellbores is that of accurately positioning the radial location of the wellbore. Another problem is the drilling of offset wellbores not withstanding the orientation of the main wellbore in that the main wellbore may be vertical, inclined, or horizontal.

SUMMARY OF THE PRESENT INVENTION

The present invention provides an improved method and apparatus for the drilling of offset wellbores from a main wellbore notwithstanding the orientation of the main wellbore be it vertical, inclined, or horizontal. In addition, the present invention can be used in both cased as well as uncased wellbores. Further, the present invention provides a method and apparatus for the precise control of radial position of each offset wellbore and with the ability to set a packer downstream of the apparatus.

The present invention provides an improved method and apparatus for the drilling of offset wellbores with respect to a main central wellbore wherein the central main wellbore can be either vertical, horizontal or slanted. The apparatus includes a tool body carried on a first larger drill string, and having a first smaller central longitudinally extending passageway that extends through the tool body. An inflatable packer is provided for sealing the main wellbore below the first passageway. The first passageway communicates with the packer so that the packer can be activated via the first passageway. The tool body also provides a second larger passageway that forms an acute angle with the first smaller passageway, the second passageway and first passageway meeting at a common entry point, placed above the activating area of the packer. The entry portion defines a shunt for routing a smaller drill bit into the second passageway which defines the initial directional drilling path for the offset wellbore.

In the preferred embodiment, the tool body can be oriented multiple times before being removed from the main wellbore so that several offset wells, each of known radial orientation, can be drilled from the main wellbore.

In the preferred embodiment, there are first (larger) and second (smaller) drill strings, each having a drill bit carried therewith, including a first larger drill bit carried below the packer on a first larger drill string and a second drill bit carried on a second smaller drill string that is disposed inside of the first drill string.

In the preferred embodiment the diameter of the second drill bit is larger than the diameter of the first passageway, so that it cannot enter the first passageway.

In the preferred embodiment, the second passageway is in the form of an elongated slot, and the second drill string has a guide key thereon for tracking the slot during directional drilling of an offset wellbore. This feature precisely orients the second drill string which typically as a bent portion to define the curvature of the offset wellbore. The guide key properly orients the bent portion of the second drill string so that curvature of the offset wellbore is maximized.

In the preferred embodiment, the second passageway has an elongated slot that includes a first larger curved portion for cradling the second drill string and a smaller second portion for receiving the guide key of the second drill string.

In the preferred embodiment, a steering or survey tool (commercially available) can be used to orient the tool body to thereby define the directional drilling position of the second passageway with respect to the main wellbore.

As used in an oilfield context, the terms "coring", or "taking cores" refers to the act of removing from the wellbore actual samples of the subterranean strata. These "cores" or samples are subsequently analyzed at the surface, yielding a multitude of data as to the physical composition and properties of the strata. Some of the information that these "cores" include porosity, permeability and grain structure. As such, yield coring represents an invaluable tool for geologists, reservoir engineers and other earth scientists.

Traditionally, core samples are taken by inserting a specialized assembly, consisting of an open center drill-bit, outer housing and inner sleeve (or core barrel) into a wellbore and advancement of this assembly using rotary drilling methods. As the assembly advances, the core is "captured" in the inner sleeve. After the desired interval is cored, the assembly is brought to the surface and the core sample removed from the barrel. Numerous advancements in coring equipment and techniques have been made in the last decade. These advancements include 1) oriented coring, 2) coring with PDM's mud motors, and 3) stackable core barrels, making it possible to core 50 feet or more in a single run.

Notwithstanding the advancements in coring technology that have been made, there are still several inherent problems that exist in extracting pure, untainted samples. The area in close proximity to the wellbore is often infiltrated by drilling fluids (bentonite, polymer, etc.). Consequently, samples obtained from areas immediately adjacent to the wellbore are often contaminated by these foreign materials. Another problem that exists is as follows: Oftentimes, it is not exactly known; prior to the running of a sweep of electric logs, the interval which is to be cored. However, after the wellbore is drilled (and logged) coring cannot be done in a conventional manner, and a sidewall core has been the only alternative. Basically a sidewall core tool contains a miniature hydraulically driven core barrel, mounted perpendicular to the wellbore axis, which can be oriented and controlled from the surface. This tool can take a small diameter core (½–1") and several inches into the desired strata. Although state of the art at present, the small diameter of the core samples coupled with the limited departure from the wellbore perimeter are two drawbacks of the method/tool. However, up until recently this was the only practical technique of obtaining core samples in a predrilled borehole. A Calgary, Alberta based firm has introduced a tool/technique to get cores that are both larger in diameter (2½"), longer in length (up to 10') and taken further from the wellbore. Unfortunately an integral step in this process involves the enlarging of a section of the wellbore in order to initiate the kickoff point of the coring. This enlarged section can (potentially) be a problem for future well operations.

The subject of this disclosure is a novel coring methodology which allows a standard size (2-3") core sample to be obtained in a predrilled (and logged) wellbore, said sample to be located at a suitable distance from the wellbore. In addition this methodology does not require a modification (enlargement) of the original wellbore. In the coring process, the deflection tool is lowered into the wellbore to the desired interval to be cored on the end of a string of large diameter drillpipe. The deflection ramp is oriented using conventional steering tool. The packer portion of the tool is inflated, using a dropped ball and the rig pumps. The large diameter drillpipe string is secured (hung off) in the rig floor slips. A coring assembly of either the conventional rotary type or the mud motor driven variety is lowered into the wellbore through the larger diameter drillpipe until it reaches the deflection tool ramp. The coring on the section is now started. The coring assembly is rotated (via either rig rotary/top head drive or the mud motor is started with pumped fluid) and the assembly is thrust into the sidewall of the wellbore. The coring assembly is advanced as far as desired. Upon completion of the coring, the coring assembly is withdrawn and the inflatable packer is deflated. If additional cores are needed, the process is repeated.

The advantages of this system are numerous. Cores can be taken away from wellbore (1'-500' for example). Numerous cores can be taken from a single wellbore. Cores can be taken from either a cased/uncased wellbore. Existing wellbore does not have to be modified (and potentially damaged). Coring can be effected in a predrilled (and logged) wellbore so that the interval can be chosen judiciously. Standard diameter cores can be obtained up to fifty feet (50') in length.

BRIEF DESCRIPTION OF THE DRAWINGS

For a further understanding of the nature and objects of the present invention, reference should be had to the following detailed description taken in conjunction with the accompanying drawings, in which like parts are given like reference numerals, and wherein.

DETAILED DESCRIPTION OF THE PREFERRED EMBODIMENT

Figure 1:
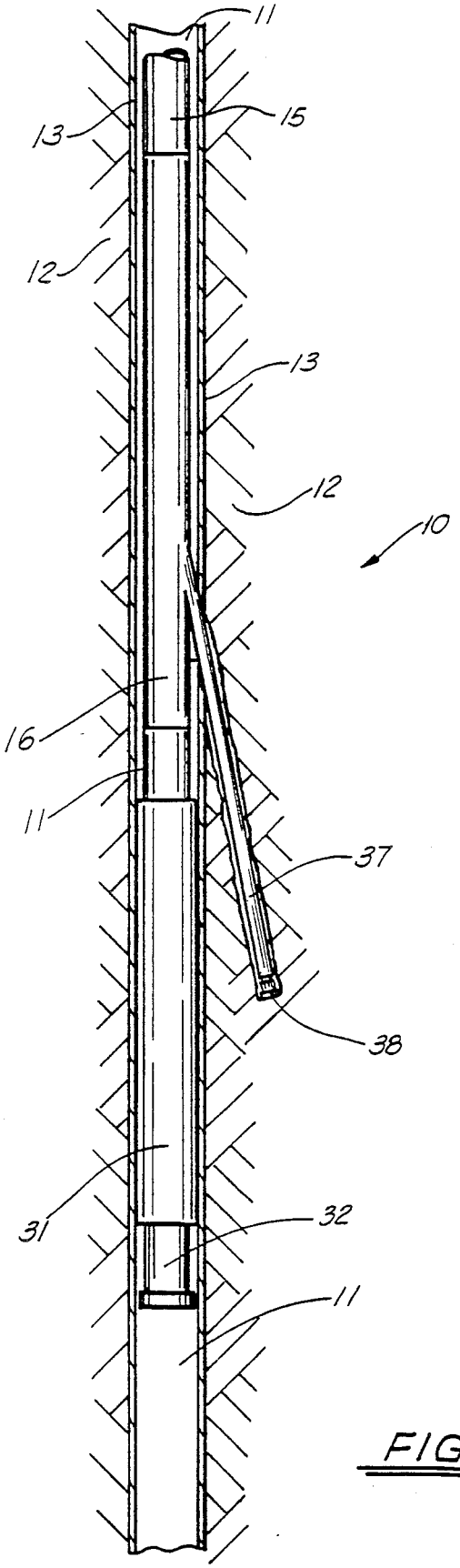
FIG. 1 is a side view of the preferred embodiment of the apparatus of the present invention.
Figure 3:
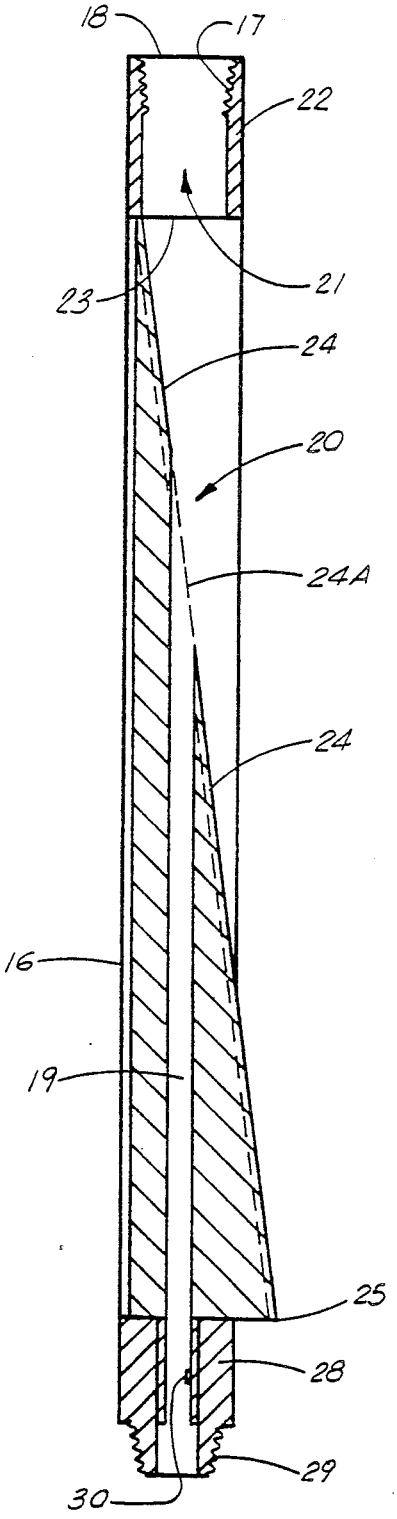
FIG. 3 is a fragmentary sectional view of the preferred embodiment of the apparatus of the present invention illustrating the directional guidance tool portion thereof.
Figure 11:
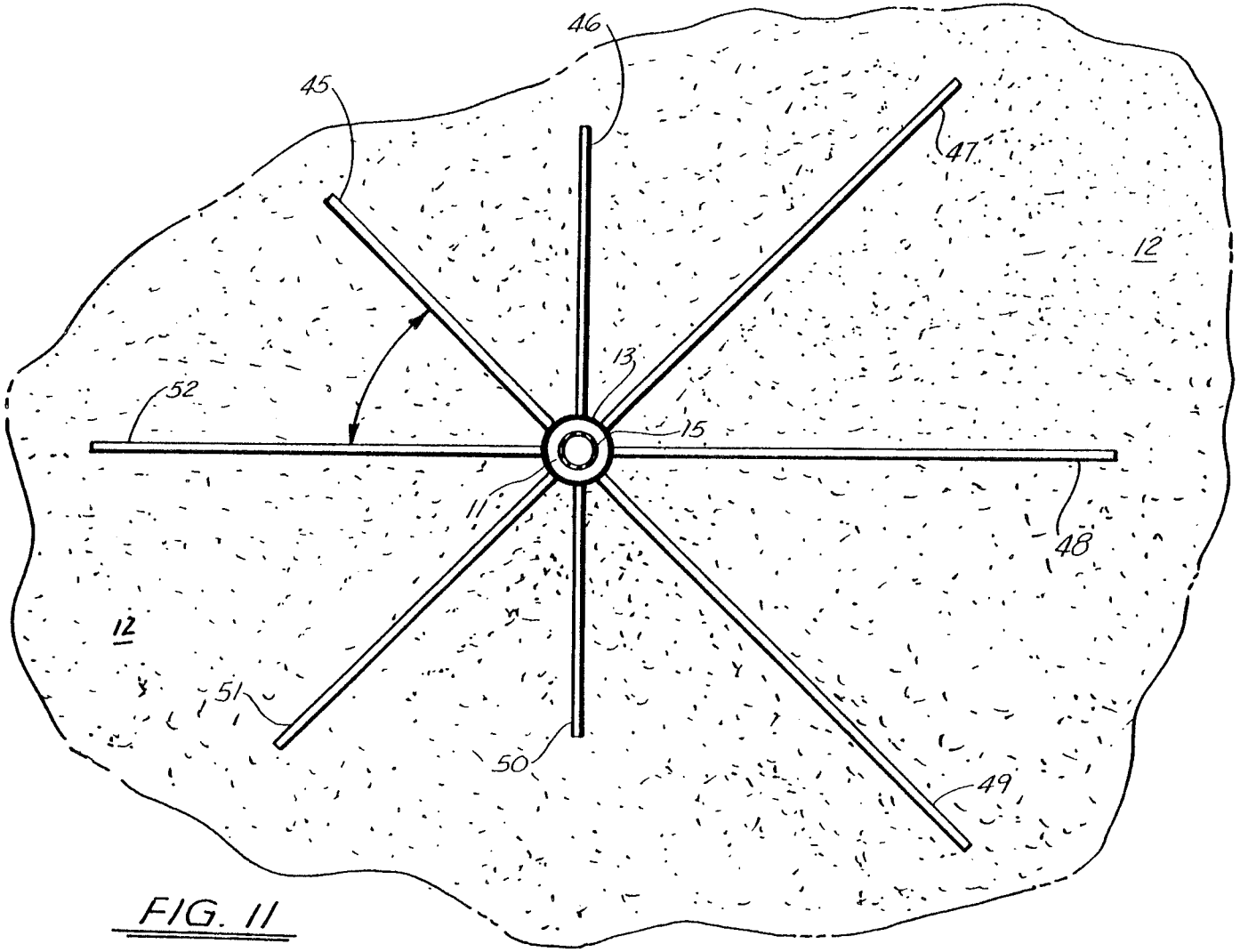
FIG. 11 is a schematic view illustrating the use of the present invention to drill a plurality of offset wellbores.

FIG. 1-3 and 10-11 illustrate generally the preferred embodiment of the apparatus of the present invention designated generally by the numeral 10. In FIGS. 1 and 11, there can be seen directional drilling apparatus 10 for deflecting a drill bit 38 from the central axial path of a main wellbore cut in a surrounding formation 12. The apparatus and method of the present invention can be used in either vertical, horizontal or slanted wellbores 11. The directional drilling using the method and apparatus of the present invention can also be used in situations where casing 13 is lining the main wellbore 11.

The apparatus 10 includes an outer drill pipe 14 attached to drill string 15 and at its lower end portion, having a tool body 16 with an internal threaded connection 17 at a first end 18 of the tool body 16.

The tool body 16 (FIGS. 1-3) has a first longitudinally extending passageway 19 that generally aligns with the longitudinal central axis of the main wellbore 11 during use.

The first end 18 of the tool body 16 has an entry area 20 that communicates with a cylindrical bore 21 portion of tool body 16 end portion 18. Bore 21 is defined by cylindrical sidewall 22 as shown best in FIG. 3. Entry area 20 communicates respectively with first passageway 19 and with a second passageway 24 that forms an acute angle with the first passageway 19.

The first passageway 19 is preferably a cylindrical conduit that extends from a beginning position at the line 24A which tracks the inclined surface 24 portion of tool body 16 as shown in FIGS. 3 and 6-9. Inclined surface 24 of tool body 16 begins at 23 which is also an end portion of cylindrical wall 22.

Figure 2:
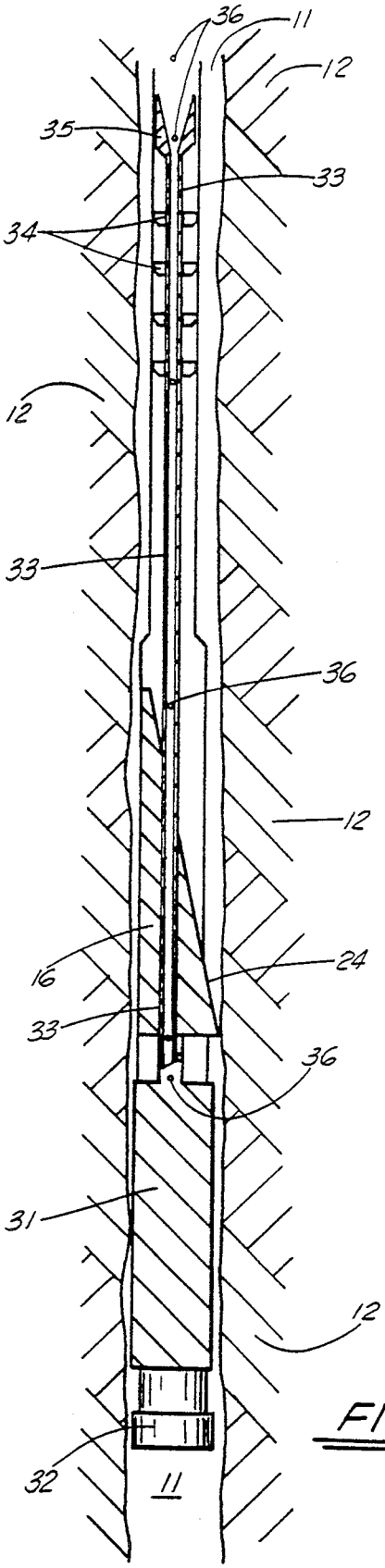
FIG. 2 is a side view of the preferred embodiment of the apparatus of the present invention illustrating the setting of the packer portion thereof.

Inclined surface 24 terminates at end portion 25 wherein externally threaded connector portion 28 of tool body 16 begins, and provides external threads 29 for attaching tool body 16 to packer element 31 which is a commercially available packer assembly. For installation of the apparatus 10 as shown in FIG. 2, packer element 31, and drill bit 32 are attached to the distal or extreme end portion of tool body 16 as shown in FIG. 2.

Figure 9:
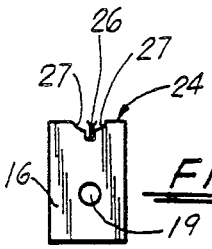
FIG. 9 is a sectional view taken along lines 9—9 of FIG. 7.
Figure 8:
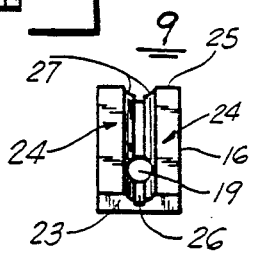
FIG. 8 is a sectional view taken along lines 8—8 of FIG. 7.
Figure 10:
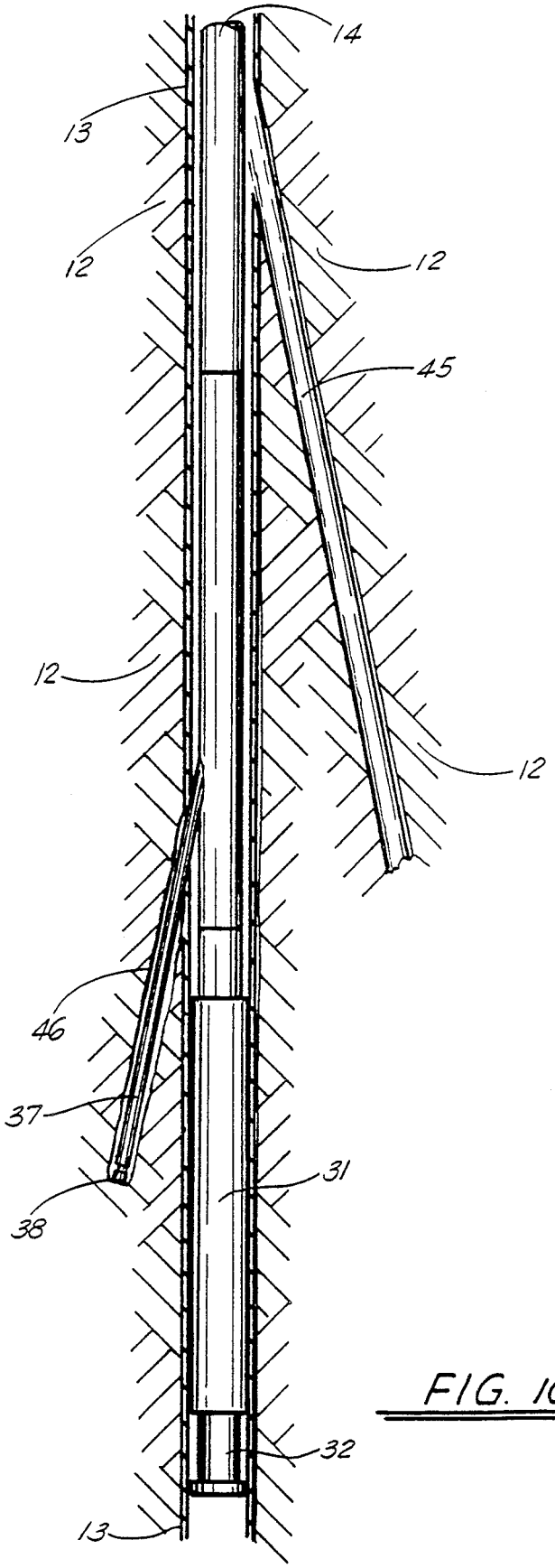
FIG. 10 is a sectional view of the preferred embodiment of the apparatus of the present invention.

The tool body 16 provides a pair of grooves 26, 27 which extend between the first end 23 of tool body 16 and the extreme end 25 of the inclined surface 24. Key groove 26 is squared in transverse section as shown in FIG. 9. A longitudinally extending mud motor guide 27 is generally curved in transverse section as shown in FIG. 9. Key groove 26 communicates with and intersects mud motor guide 27 as shown in FIG. 9. During directional drilling, the mud motor 37 (which forms a second, smaller drill string) deflects away from the larger drill string 15 when the mud motor 37 and bit engage 38 inclined surface ramp 24. The bit 38 and mud motor 37 are sized so that they are larger in diameter than the first passageway 19. When the drill bit and mud motor 37, 38 enter the entry area 20 of tool body 16, the drill bit 38 and mud motor 37 track inclined surface 24 and more particularly track the mud motor guide 27.

Orientation of the mud motor and bit 37, 38 is controlled by guide key 40 which registers with key groove 26. A commercially available steering tool can be used to position the tool body 16 in the proper radial orientation with respect to the surrounding formation 12 so that a radial bore hole 45–52 of desired radial orientation can be drilled as shown in FIG. 11. Similarly, a steering tool can be used to properly orient the mud motor 37 and drill bit 38 so that the guide key 40 meets with the key groove 26. These steering or survey tools are commercially available.

Packer element 31 is a commercially available packer element which can be for example a Tam-J inflatable packer supplied by Tam International as an example. The packer 31 is preferably activated using setting ball 36 which is dropped into the main wellbore 11 and allowed to fall downwardly. In FIG. 2, setting of the packer is illustrated. A jumper bar 33 is attached to the tool body 16. The jumper bar 33 is connected to the upstream portion of tool body !6 while the packer element 31 is connected to the downstream portion thereof as shown in FIG. 2. Ball receiver portion 35 of jumper bar 33 includes a funnel or conical shaped inlet section 53 so that the ball 36 will travel into the bore 54 of jumper bar 33. Ball 36 travels through the bore 54 and through the first passageway 19 of tool body 16 which is also occupied by the hollow jumper bar 33.

Setting ball 36 reaches the packer element 31 and pump pressure is raised and the ball 36 activates the packer to set. The setting ball 36, as used for the purpose of setting packer 31 is a commercially available assembly. Centralizer members 34 can be used to properly position the jumper bar 36 with respect to the surrounding wellbore 11, casing 13 or the like.

Figure 4:
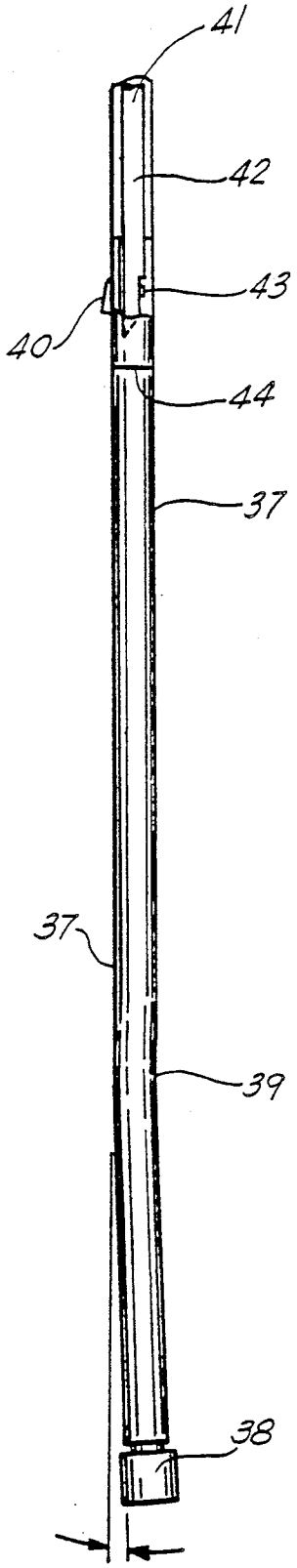
FIG. 4 is a fragmentary side view of the preferred embodiment of the apparatus of the present invention illustrating the offset drilling portion thereof.
Figure 5:
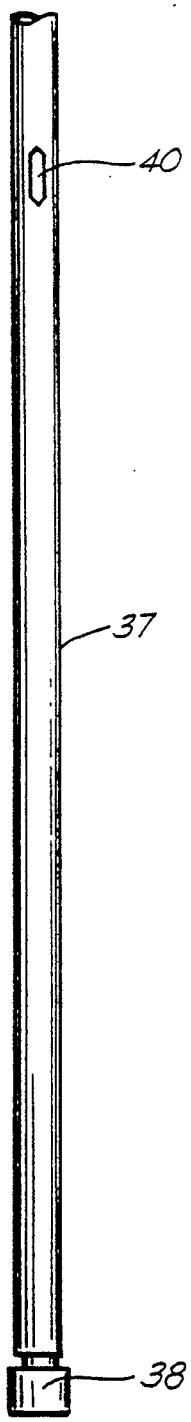
FIG. 5 is a fragmentary view of the preferred embodiment of the apparatus of the present invention illustrating the mud motor, bit and guide key portions thereof.
Figure 6:
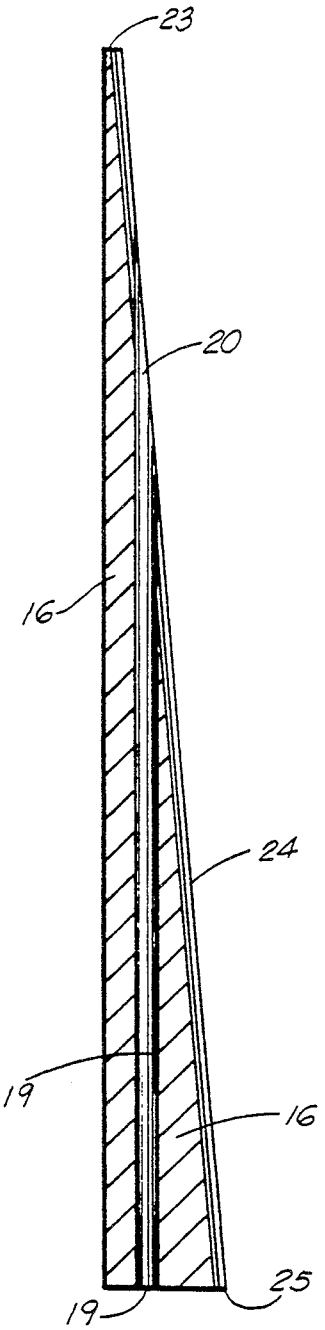
FIG. 6 is a sectional, fragmentary view of the preferred embodiment of the apparatus of the present invention illustrating the guidance tool body.
Figure 7:
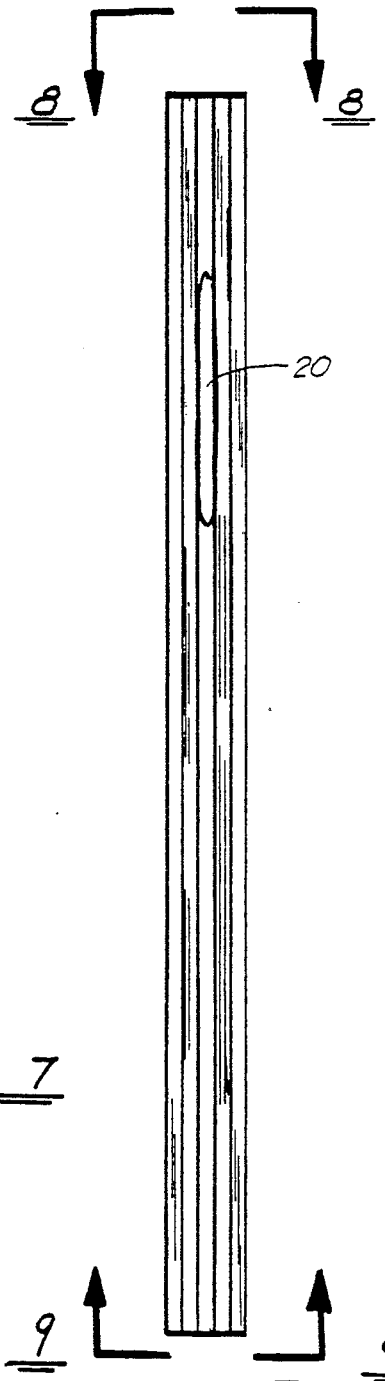
FIG. 7 is another fragmentary view of the preferred embodiment of the apparatus of the present invention illustrating the guidance tool body.

The mud motor 37 and drill bit 38 can also be provided with a bent sub 39 portion which is shown in FIG. 4. The guide key 40 and the angle of bend of the bent sub 39 are in a common plane so that when the guide key 40 registers within the key groove 26, the bent sub is oriented so that the drill bit extends away from the tool body 16. This maximizes the directional drilling angle of the offset wellbores.

In FIG. 4, steering tool 41 and orienting stinger 42 are shown together with orientation key 43. The stinger is simply a section of pipe that connects with the mud motor 37, bent sub 39 and bit 38. The orienting stinger provides a commercially available steering tool, a means for defining the radial or angular position of the mud motor so that the drilling personnel will know exactly where the bent sub is directed.

In the method of the present invention, the main bore hole 11 is first drilled using a vertical, slant, or horizontal wellbore and it ca be cased using casing 13 if desired. If a slanted bore hole 11 is desired as the initial main wellbore 11, a common directional drilling rig and directional drilling techniques are employed.

The first larger drill string 15 is first used to place the tool body 16 and packer element 31 in the wellbore 11. The first larger work string or drill string 15 can be for example five inch (5") drill pipe. Once the larger or first drill string 15 is placed in the well, the proximate end portion of the drill string 15 is secured at the rig floor with slips. The driller then pumps down a steering tool (a commercially available directional steering device manufactured by Sperry or Smith for example), and this steering or orientation tool is used to properly orient the deflection ramp portion of the tool 12. Adjustments are made by rotating the 5' larger drill string from the surface and resecuring at the rig floor.

The larger drill string 15 is then rotated so that the driller knows the orientation (i.e. a desired orientation) of the tool body 16 and thus the orientation of the inclined surface 24. Once the desired radial orientation of the tool body 16 and its ramp 24 is determined, the steering tool is retrieved using a wireline.

The next step of the method requires a jumper tool 33 to be placed in the wellbore. Jumper 33 drops to a position adjacent the tool body and centralizers 34 align the jumper 33 with the first passageway 19 and seal the outside of the jumper 33 with respect to the main wellbore 11. The work string bore can be very precisely milled to be the same size as the centralizers 34 in diameters so that a good fit and seal is achieved.

The setting ball 36 is pumped to the jumper 33 at the funnel shaped inlet 53, and then to the packer 31 so that pump pressure can be used to inflate the packer and set the packer. The setting ball 36 inflates the packer 31 and that assembly is a commercially available assembly manufactured by Tam International, as an example. After the packer is set, a wireline can be used to remove the jumper bar 33 and pull it out of the main wellbore 11.

The drilling of a plurality of offset wellbores 45–52 begins with the use of a small drill string that includes at its lower, extreme end a mud motor 37, drill bit 38 and bent sub 39. This small drill string (37–39) employs for example a three inch (3") diameter mud motor, drill bit and bent sub. The small passageway 19 has a maximum diameter of about one and a half to two inches (1½–2"). Therefore, the small drill string end portion comprised of mud motor 37, bit 38 and bent sub 39 will not enter the small passageway 19. The small drill string (including mud motor 37, bit 38 and bent sub 39) can be supplied with a commercially available steering tool for proper orientation of the mud motor 37 and the bent sub 39. The alignment guide key 40 is then aligned with the key groove 26 using the steering tool. Now, drilling of an offset wellbore 45–52 is begun at a radial orientation which is known, because it is the same as the radial orientation of inclined surface 24.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A directional drilling apparatus for deflecting a drill bit to drill an offset borehole from the central axial path of a main wellbore of vertical, horizontal, or slanted orientation, comprising:

a) a tool body having a first, central longitudinally extending passageway that extends through the tool body;

b) inflatable packer means for sealing the main wellbore below the first passageway;

c) means in the first passageway for activating the packer so that it will inflate;

d) the tool body having a second passageway that forms an acute angle with the first passageway, the second passageway having an entry portion that intersects the first passageway above the activating means; and e) the entry portion having means for routing the drill bit into the second passageway.

2. The apparatus of claim 1 wherein the tool body can be oriented multiple times before being removed from the main wellbore so that several offset wells can be drilled from the main wellbore.

3. The apparatus of claim 1, wherein there are a pair of drill bits including a first drill bit carried below the packer, on a first drill string and a second drill bit carried on a second drill string disposed inside the first drill string.

4. The apparatus of claim 3 wherein the diameter of the second drill bit is larger than the first passageway.

5. The apparatus of claim 1 wherein the second passageway has an elongated slot, and the second drill string has guide key means thereon for tracking the slot.

6. The apparatus of claim 5, wherein the second passageway has an elongated slot that includes a first larger curved section for cradling the second drill string, and a second portion for receiving the guide means.

7. The apparatus of claim 1 further comprising tool body radial orientation means that can enter the first passageway for radially positioning the tool body with respect to the main wellbore.

8. A method of drilling one or more offset wellbores from a first main wellbore comprising the step of:

a) drilling the initial main wellbore;

b) placing a first, larger drill string in the initial wellbore that has a tool body with first and second passageways therein forming an acute angle with respect to one another;

c) orienting the radial position of the second passageway with respect to the initial, main wellbore using a steering tool;

d) placing a second, smaller drill string in the main wellbore and inside the first drill string, the second drill string having a diameter larger than the first passageway;

e) diverting the second drill string to the second passageway at a position upstream of first passageway;

f) tracking the second passageway with the second drill string during drilling of an offset wellbore that forms an angle with the first borehole.

9. The method of claim 8 wherein the first and second passageways are rigidly affixed to one another.

10. The method of claim 8 wherein the larger drill string carries a packer that can be set downstream of the first passageway.

* * * * *